US005619808A

United States Patent [19]

Pabst

[11] Patent Number: 5,619,808

[45] Date of Patent: Apr. 15, 1997

[54] APPARATUS FOR BLOWING AIR AT A LENGTH OF TEXTILE FABRIC

[75] Inventor: Manfred Pabst, Cologne, Germany

[73] Assignee: A. Monforts GmbH & Co., Moenchengladbach, Germany

[21] Appl. No.: 387,800

[22] PCT Filed: Aug. 18, 1993

[86] PCT No.: PCT/DE93/00747

§ 371 Date: Feb. 17, 1995

§ 102(e) Date: Feb. 17, 1995

[87] PCT Pub. No.: WO94/04740

PCT Pub. Date: Mar. 3, 1994

[30] Foreign Application Priority Data

Aug. 26, 1992 [DE] Germany ..... 42 28 454.6
Aug. 26, 1992 [DE] Germany ..... 42 28 453.8

[51] Int. Cl.[6] ..... F26B 9/00

[52] U.S. Cl. ..... 34/640; 34/644

[58] Field of Search ..... 34/629, 638, 639, 34/640, 643, 644, 646, 652; 26/106

[56] References Cited

U.S. PATENT DOCUMENTS

| | | | |
|---|---|---|---|
| 3,099,291 | 7/1963 | Schlecht et al. | 34/644 |
| 4,292,745 | 10/1981 | Caratsch | 34/644 |
| 5,201,132 | 4/1993 | Jacob | 34/463 |

FOREIGN PATENT DOCUMENTS

| | | | |
|---|---|---|---|
| 1331649 | 6/1962 | France . | |
| 596657 | 9/1931 | Germany . | |
| 631625 | 11/1936 | Germany . | |
| 843386 | 7/1949 | Germany . | |
| 1272267 | 8/1963 | Germany . | |
| 2156956 | 11/1971 | Germany . | |
| 2934967 | 3/1980 | Germany | 34/644 |
| 3835000A1 | 10/1988 | Germany . | |

*Primary Examiner*—John M. Sollecito
*Assistant Examiner*—Steve Gravini
*Attorney, Agent, or Firm*—Shefte, Pinckney & Sawyer

[57] ABSTRACT

An apparatus for blowing air at a spread-out length of textile fabric being transported onward can be reduced in its dimensions and at the same time made more favorable from an energy standpoint during operation if the blow-out nozzles are embodied as injector nozzles. The injector nozzles can be flexibly adapted, in terms of their distribution in three dimensions, to the width of the length of fabric.

11 Claims, 4 Drawing Sheets

APPARATUS FOR BLOWING AIR AT A LENGTH OF TEXTILE FABRIC

Figure 1:
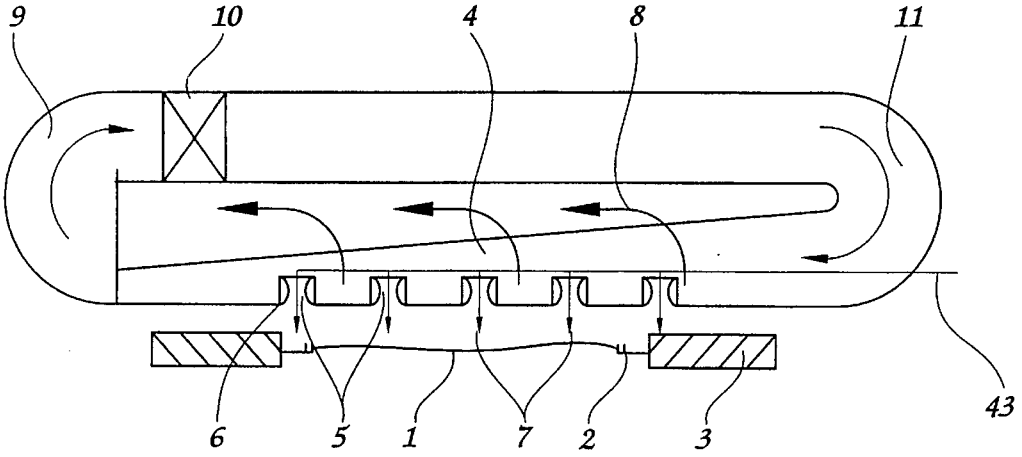

The invention relates to an apparatus for blowing air at a spread-out, continuously transported length of textile fabric with the aid of an optionally heated treatment gas, flowing in accelerated fashion toward the length of fabric, and with blow-out nozzles disposed on one or both sides of the surface of the length of fabric and aimed at the length of fabric, particularly in a tentering frame or a hot flue in the textile industry, wherein an injector is provided to accelerate the treatment gas.

For drying and/or fixing lengths of textile fabric, convection drying and/or fixing machines are used. Conventional examples are a nozzle tentering frame (flat dryer) or a hot flue (loop dryer), in which heated air is blown continuously—flat (tentering frame) or in loops (hot flue) from hole- or slit-type nozzles onto the length of fabric being transported that is to be treated. Such a machine usually comprises a plurality of fields connected one after the other, through which the length of fabric to be treated must be passed continuously, over rollers or over screen belts and/or pinned or fastened by the long edges, guided by chains or passing in loops over rollers.

In the tentering frame, every field, which is approximately 3 m long, for instance, conventionally has at least two recirculating air fans in the transport direction of the fabric, and generally per fan one blower or nozzle chest pointing toward the top side of the length of fabric and one toward the bottom side of the fabric (generally in the form of outlet slits with nozzle prongs extending transversely to the transport direction of the fabric), with blowout nozzles, so-called slit- or hole-type nozzles, embodied as blow-out holes. The blower chests are assigned to the recirculating air fans. They aspirate the blown-out air—after it has performed work at the fabric—back into circulation via heat exchangers, direct heating or the like. In the hot flue, the blow-out nozzles, namely outlet slits of the blower chests, are aimed at the loops.

With this kind of known machine a length of fabric, spread out and guided, can be treated from a thickness of only a few tenths of a millimeter; however, the heating and air acceleration systems—especially in a tentering frame need so much room that the height of this machine measured vertically to a horizontally guided length of fabric is generally on the order of 2 m.

Another problem of conventional apparatuses of the type generically described at the outset, especially in the tentering frame, is that the spacing between the air outlet openings toward the fabric to be treated of the blow-out nozzles and the surface of the fabric must often be greater than would be desirable from an optimal outcome of treatment, and especially drying performance, because there is a need to displace not only the length of fabric but also its chain guides, which engage the long edges of the fabric, back and forth in accordance with the width of the fabric between the blower chests or nozzle fields disposed above and below the fabric to be treated.

The result is the disadvantage that the nozzle fields of the blower chests aimed at the fabric cannot perform any work in more or less wide edge regions of the fabric—for instance in the tentering frame—except when treating a length of fabric that is the maximum width for the given machine. In those edge regions, the treatment air is either blown out uselessly, or the nozzle openings are closed in some way in the peripheral strips in question.

German Patent 596 657 describes an apparatus for drying moving lengths of textile fabric in which the lengths of fabric are guided in a horizontal zig-zag through the drying chamber. To enable operating the known apparatus without a fan, the supply line and outgoing line for dry air are embodied in injectorlike fashion, and suction connections at the drying chamber are provided, in such a way that through the air supply line some of the blown-in air can be reaspirated, and through the outgoing air line cooling air can be passed through the lower part of the drying chamber. An injector provided at the outlet point from the drying apparatus might indeed replace a fan, but the relatively great total height of the machine is hardly decreased thereby compared with the prior art that does have fans.

In Published, Unexamined German Patent Application DE-OS 38 35 000, in a compact dryer element in a drying machine, hot blowing air for the drying path can be generated by using an infrared radiator to heat a heating tube from outside, the heating tube extending parallel to the infrared radiator. The hot blowing air passes through a 180° elbow into a blower strip extending parallel to the heating tube. A reflector surrounding the heating tube and blower strip unit reflects infrared radiation onto the heating tube and gives up the radiant energy absorbed by it to a secondary air flow, which upon leaving the blower strip is admixed with the hot main air stream. However, an arrangement of this kind cannot be used in the apparatuses referred to at the outset, of the type of a tentering frame or a hot flue, because the heat generation by infrared radiation is too expensive in that field, and because either the air supply capacity is too low, or the dryer element must have even greater dimensions than those with which they are already provided in the apparatuses of the generic type here.

In Published, Unexamined German Patent Application DE-OS 16 04 787, a nozzle housing for a dryer for lengths of textile fabrics is described, in which the operating width of the nozzle outflow can be adapted to the width of the fabric. To that end, nozzle housings that can be displaced into one another in telescoping fashion and side by side are disclosed. Although this does make it possible to aim all the air blown into the nozzle housing at the surface of the fabric, nevertheless the spacing between the blow-out nozzles and the fabric, as in earlier nozzle housings, is necessarily at least so great that there is no room, between nozzle chests that face one another, for the chain guides that engage the long edges of the fabric. In Published, Unexamined German Patent Application DE-OS 32 47 459, a heat treatment chamber for lengths of materials is described that has nozzle chests extending in pairs above and below a length of textile fabric, crosswise across the width of the fabric. The nozzle chests are not rigidly connected to the air supply line but instead are separate and form an open end toward the air supply line. Each of the open ends are connected pivotably to pivot arms, while conversely the closed ends are joined together by a cable via a deflection. By pivoting the pivot arms in opposite directions, the mutual spacings of the nozzle chests facing one another are varied. The known arrangement does allow a variation of the spacing between the surface of the treated length of fabric and the blow-out openings of the nozzle chests, but this reduction in spacing—as in earlier rigid nozzle chests—has a limit in terms of the thickness, measured vertically to the surface of the fabric, of the chain guides that are required at the edge of the fabric.

This object is attained in the apparatus of this generic type in that each individual blow-out nozzle is itself embodied as an injector nozzle.

The object of the invention is generally to reduce the dimensions of the apparatus described at the outset and to make its operation more favorable from an energy standpoint. In particular, the old technology, with the many expensive fans and the associated electrical drives, is to be replaced by injector technology for accelerating the treatment gas.

In modern injector technology, injector nozzles generate large volumetric flows—based on a small amount of compressed air supplied via a line (any other gas may be used as the air). By the inflow of a certain volume of compressed air into an injector nozzle—depending on its geometrical construction—a multiple of the ambient air is aspirated (from the surroundings of the nozzle) and expelled in accelerated fashion. With commercially available injector nozzles, the amplification factors vary on an order of magnitude of between 1:10 and 1:25. The cross section of the applicable compressed air supply line can be correspondingly small. Injector nozzles, which are also known on the market as Coanda, Venturi, ejector and transvector nozzles, are therefore suitable gas accelerating means.

Accelerating the mass of the working gas accordingly does not, according to the invention, take place at any arbitrary place in the machine but rather essentially in the blow-out nozzles themselves, which are embodied as injector nozzles. These many individual injector nozzles may be coupled to the compressed air source, which is provided either outside the machine or centrally at the machines, each being coupled via a relatively thin and preferably flexible line. Including the line system, the height of the machine, measured in the direction vertically to the surface of the fabric, can therefore be reduced to values that are in the order of magnitude of the height of conventional blower chest arrangements themselves.

If in a tentering frame, for instance, the air feeders (such as fans, but injectors, specifically recirculating air and/or fresh air injectors are also possible) connected to all the blow-off nozzles are replaced by the individual injector nozzles, then at the same time the otherwise-necessary voluminous air delivery ducts can be omitted at the same time, since the compressed air supplied to the injector nozzles can be connected via relatively thin lines to a compressed source, such as a compressor, that remains outside the machine. Such a compressed air source can preferably supply all the nozzle fields of the machine or even a plurality of machines simultaneously, for instance via one main tube with branch lines to each field. Quite similar advantages are obtained in a hot flue, where the elimination of all the recirculating air drives also results in a considerable savings of space and expense.

The nozzles according to the invention can be impinged upon or supplied with cold or heated air, but also with other gases, including steam, and especially water vapor under pressure, for treating the length of fabric. Since in general to operate the individual injector nozzle arrangement, only one compressed gas source, common to all the nozzles is necessary for the entire machine, it is possible in accordance with a further feature of the invention to use a gas turbine at this point. Preferably, the waste heat is provided for heating the treatment gas, particularly via a heat exchanger, and the compressed air (intermediate tapping) of the gas turbine is provided for driving the injector nozzle, but a turbocompressor can also be driven with the shaft output of the turbine.

In accordance with a further feature of the invention, in an apparatus of the kind referred to at the outset for blowing a treatment gas at a length of textile fabric transported continuously onward between two chain guides or the like, the injector nozzles or their blow-out holes are disposed essentially in one plane parallel to the surface of the fabric, individually or in groups in predetermined and preferably equal mutual spacings in a fastening and air supply system that can be adapted to the width of the particular fabric.

The invention creates a system of injector nozzles aimed at the fabric, the spacing of which nozzles can be adapted to the width of the particular fabric being treated in such a way that all the nozzles can be aimed at the fabric, in a denser arrangement for a narrower fabric or with relatively large mutual spacings for a relatively wide fabric. Both the fastening system and the air supply system of the individual injector nozzles should accordingly be capable of flexibly following the width of the particular fabric being treated.

This further embodiment not only assures that all the injector nozzles of the machine are always aimed at the fabric to be treated, regardless of its width, but it also becomes possible to bring the blow-out openings of each individual nozzle as close to the surface of the fabric as desired, solely for the sake of optimizing the effect the treatment gas is intended to achieve.

The slight spacing between the nozzle openings and the surface of the treated fabric becomes possible because the nozzles according to the invention can be disposed precisely where they blow directly at the fabric. It is accordingly impossible in this arrangement for nozzles or nozzle openings to strike against or blow at the chain guide or the like located laterally of the long edges of the fabric. The spacing between the blow-out holes of the injector nozzles and the surface of the treated fabric can accordingly be less than the structural height, measured in the same direction, of the portion of the chain and chain guide located above the plane defined by the surface of the fabric. In other words, this means that the mutual spacing between two nozzles aimed at opposed points on the surface of the fabric can be substantially slighter than the thickness, measured in the same direction, of the chain and chain holding the edge of the fabric.

The fastening system for the injector nozzles, which is preferably adaptable to the width of the particular fabric, has as a prerequisite a suitably flexible air supply system to the nozzle. In this sense, the invention departs from the use of conventional, substantially one-piece blow-out chests that have nozzle openings with a fixed mutual spacing oriented toward the fabric.

When the nozzles according to the invention are used, the structural chest, which is essentially invariable in its form during operation, is preferably replaced with a flexible air supply system, in which the injector nozzles are connected individually or in groups to a system that feeds the particular treatment gas, each via one preferably at least partly flexible line.

In accordance with a further feature of the invention, a scissors system or accordion system may be provided as the fastening system that is flexible in terms of the width of the fabric to be treated. Such a system, or a similar system, may comprise individual bars or tubes—in particular with springs as the spacers—that carry the individual injector nozzles and that can be adapted in scissorslike or accordionlike fashion or over the total width in the same way to the width of the fabric to be treated. Each of the individual nozzles can then be connected via a single line or a line system to the above-described recirculating air system of the machine. If edge drying is especially desired, then the nozzles may also be aimed only at the edge regions of the fabric or may be impinged upon only there with the treatment gas; in the latter alternative, only the edge nozzles for instance are then coupled to the gas supply. To improve a length of fabric that has not yet been treated uniformly enough in its surface, it may also be favorable for the compressed air supply to the injector nozzles to be controllable separately, individually or in groups, from the supply to the other nozzles, and/or for the nozzle density, or in other words the number of nozzles per unit of surface area, is adjustable to achieve equal or unequal blowing of air at the surface of the fabric.

The individual injector nozzles may be distributed equally (for instance also equidistantly) for each fabric width, with the aid of the fastening system, so that the fabric is treated the same way everywhere over its width. Alternatively, however, the system may also be embodied such that intentionally, air is blown at the fabric unequally over its width—for instance to compensate for unequal pretreatment. To that end, by way of example, a suitable control of the compressed gas supplies to the nozzles individually or in groups, such as differently at the edge and in the middle of the length of fabric—or a correspondingly intermittent increase or decrease in nozzle density (number per unit of surface area) suffices. According to the invention, each individual blow-out hole of the blower chests belongs to one injector nozzle. Since such injector nozzles are provided in great numbers and each essentially needs to replace only one blow-out hole of a blower apparatus, each nozzle needs to produce only a relatively slight power. The supplied quantity of compressed air amounts to only a fraction of the quantity of air expelled. It should be emphasized that the invention relates to all nozzle elements that can be used similarly advantageously along the lines of the invention. This is true even if these air flow amplifiers are not injector nozzles in the strict sense.

Figure 2:
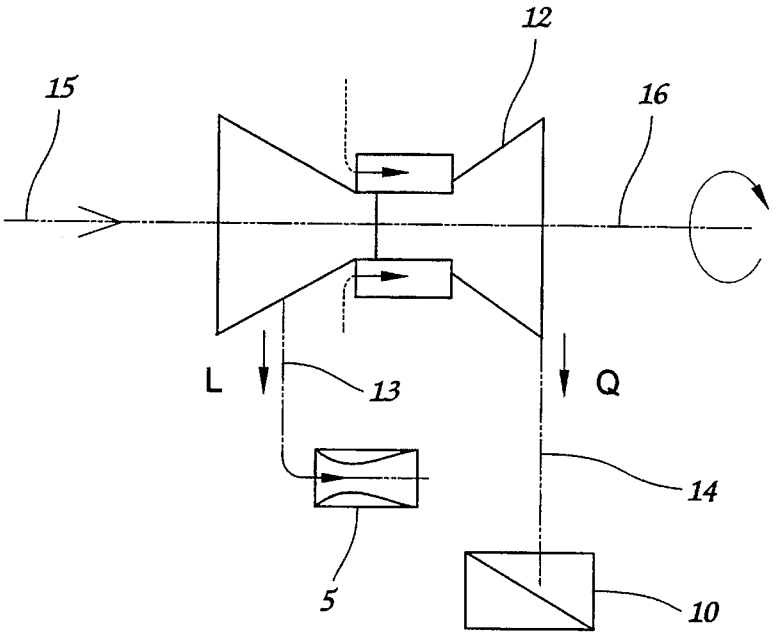
Figure 3:
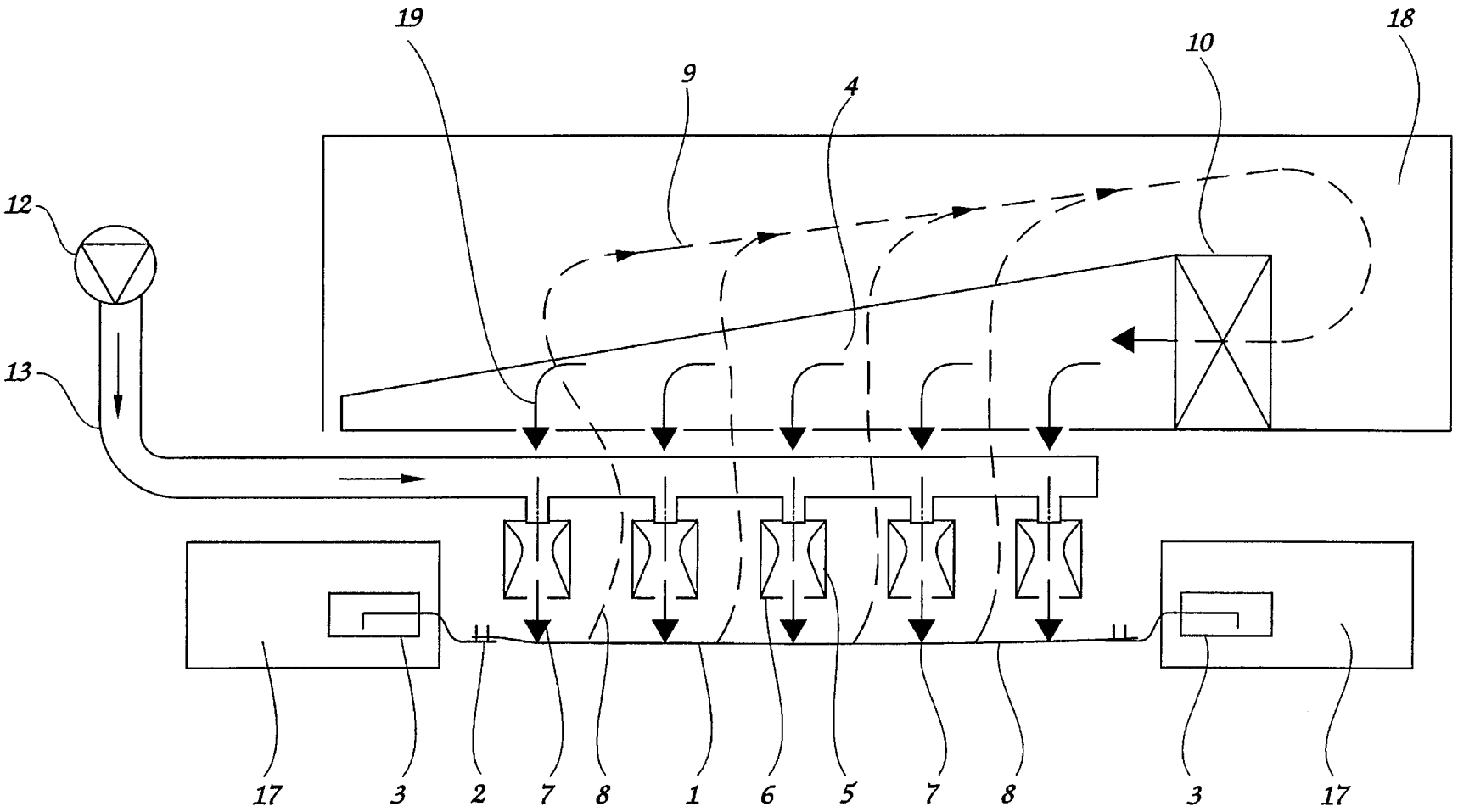
Figure 4:
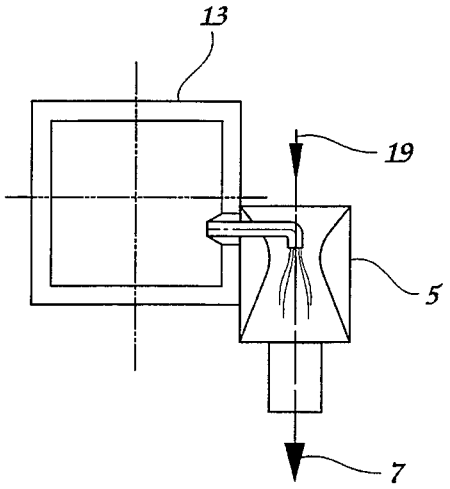
Figure 5:
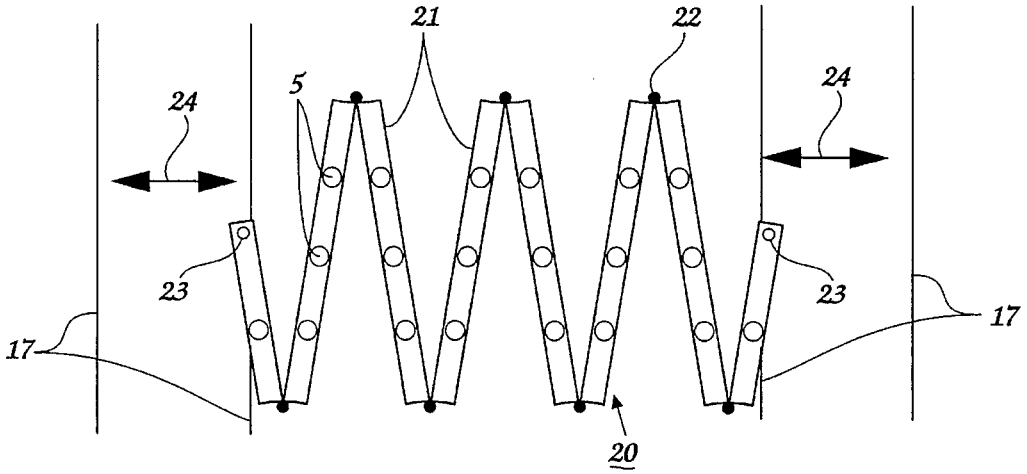
Figure 6:
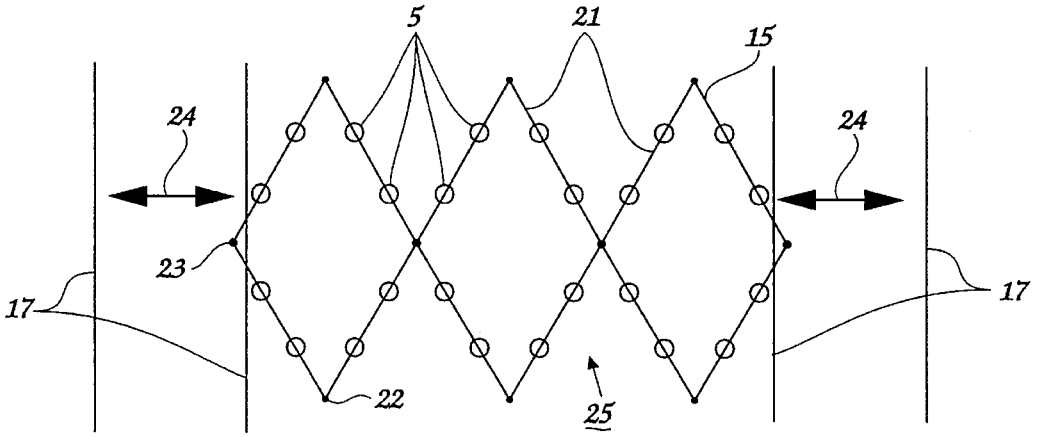
Figure 7:
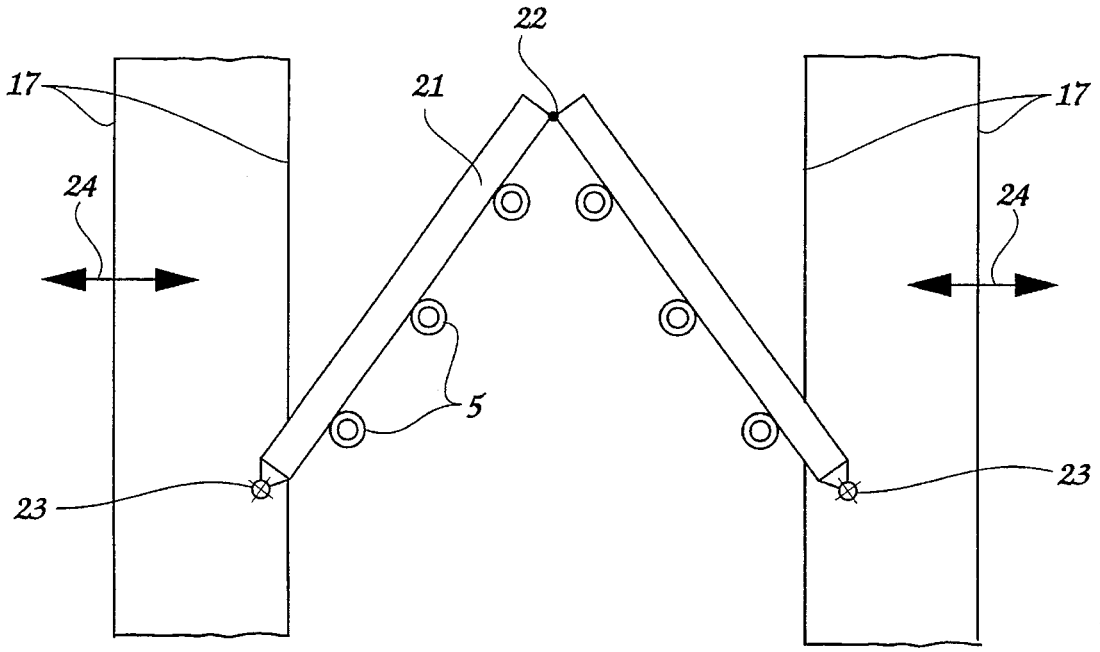
Figure 8:
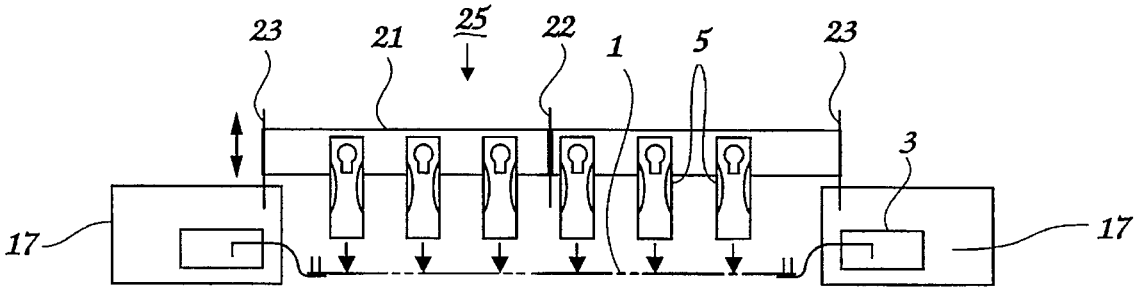

Details of the invention will now be described in conjunction with the schematic drawing of exemplary embodiments, for use in a tentering frame. Shown are:

FIG. 1, a cross section through a tentering frame nozzle field oriented toward a length of textile fabric, in each individual nozzle is embodied as an injector nozzle;

FIG. 2, a drive mechanism, such as a gas turbine, for supplying compressed air and heat to the injector nozzles of FIG. 1;

FIG. 3, a fragmentary cross section through a tentering frame with a nozzle field comprising individual injector nozzles that are movable relative to one another;

FIG. 4, an individual injector nozzle in cross section with a compressed air connection line;

FIG. 5, a first support device, to be adapted to the width of the fabric to be treated, for receiving the individual active nozzles of FIG. 3;

FIG. 6, a scissorslike support device for receiving the individual nozzles, which are to be adapted to the width of the fabric to be treated;

FIG. 7, an enlarged view of a portion of the support device of FIG. 6; and FIG. 8, a cross section at right angles to the plane of the fabric through the support device of FIG. 7.

FIG. 1 shows a portion of a tentering frame cross section at right angles to the plane of a length of textile fabric 1 to be treated, which is held on its long edges in tenterhooks or—as shown—pins 2. The pins 2 secured to chains 3 are moved forward in the transport direction that extends at right angles to the plane of the drawing. Located above the fabric 1 is an upper blower chest 4 with a number of blow-out holes 6 embodied as injector nozzles 5. A lower blower chest (not shown), likewise with many blow-out holes embodied as injector nozzles, may also be located below the fabric 1. Each of the blower chests can (as usual) have nozzle prongs extending transversely to the fabric transport direction, between which return gaps for the returning/recirculating air are left open.

From the injector nozzles 5, the outflowing air 7 flows in the direction of the arrows and strikes the fabric 1 essentially vertically; from there, the air, if the fabric 1 is essentially impermeable to air is reflected upward and optionally downward as returning air 8. The returning air 8, which is essentially the air that has done work at the length of fabric 1, can be aspirated in the flow direction 11 by the injector nozzles 5, through a recirculating air loop 9, for instance via a heat exchanger 10. In order to make the air output of each of the injector nozzles 5 approximately equal, it may be practical to dispose the injector nozzles 5, similarly to what is done in the conventional machine of this type, on a blower chest 4 whose cross section decreases in the flow direction 11 of the incoming air stream.

The injector nozzles 5 of FIG. 1 can be supplied with compressed air from an arbitrary reservoir or compressed air source. To heat the recirculating air, a heat exchanger 10 of any design, but also a direct air heater such as a gas burner, may be used. It may be favorable if the injector nozzles 5 of the particular apparatus are supplied from a gas turbine 12 (FIG. 2) both directly with compressed air and—above all by way of the recirculating air 9—with heat.

In FIG. 1, it is provided in particular that all the injector nozzles 5 be supplied via one common compressed air line 13. This compressed air line 13 may as in FIG. 2 preferably begin at the gas turbine, identified overall by reference numeral 12, whose waste heat Q is to be conducted along a heat transport line 14 and whose generated compressed air L is to be conducted along the compressed air line 13 to the individual injector nozzles 5. The gas turbine 12 has an air inlet 15 and a shaft 16. The shaft output can additionally be utilized for generating compressed air.

The drawing of FIG. 3 shows—similarly to FIG. 1—the basic layout of a portion of a tentering frame, equipped according to the invention, in a cross section at right angles to the surface of a length of fabric 1 to be treated. One substantial change compared with the conventional design here is that the blow-out nozzles or in other words injector nozzles 5, which are oriented directly toward the fabric 1, are disposed movably relative to one another individually or in groups, such that the width of the entire nozzle field can always be adapted flexibly to the width of the particular fabric being treated.

In FIG. 3, identical or equivalent parts to FIGS. 1 and 2 are shown. The chains 3 run in chain guides 17. Located above—and in actual practice also below—the length of fabric 1 is a number of blow-out holes 6, embodied individually as injector nozzles (usually each in one plane).

Each injector nozzle 5 is connected to a compressed air line 13, supplied from a compressed air source, such as the gas turbine of FIG. 2. The outflowing air 7 expelled by the injector nozzle 5 can, as returning air 8, be reaspirated as incoming air 19 by the individual injector nozzles 5 through a pronged blower chest 4 into a return chamber 18 and from it via a heat exchanger 10 and the blower chest 4; in principle, the injector nozzles 5 can naturally also aspirate fresh air, or a mixture of recirculating air and fresh air. The guidance and separation of the returning air 8 and incoming air 9 can be done essentially as in conventional tentering frames. For the quantity of compressed air introduced, optionally continuously, into the recirculating air system in the case of injector nozzles 5, equalization may be done, for instance by metering of the amount of waste air from the system.

One exemplary embodiment of an injector nozzle 5 in cross section is shown in principal in FIG. 4. This nozzle is supplied from the compressed air line 13 shown. It aspirates ambient air or incoming air 9 in the direction of the arrow and expels outflowing air, accelerated, in the direction of the length of fabric 1.

The individual injector nozzles 5 are preferably disposed on a fastening system that is adaptable to the width of the fabric 1, an example being a support device 20 of FIG. 5. As will be described in conjunction with FIGS. 5 ff., the fastening system may for instance comprise individual bars or tubes 21, which at the same time perform or can take over the function of compressed air supply, and which are coupled to one another via hinges 23 or the like. From the schematic drawing of FIG. 3, it can be seen that the blow-out holes 6 of all the individual injector nozzles 5 can be brought substantially closer to the fabric 1 at a spacing 101 than would be possible if—as in the prior art—space for the chain guide 17 has to be left between the blow-out holes 6 and the surface of the fabric 1. When the invention is employed it is even possible to make the chain guide 17 substantially thicker than before in the direction at right angles to the surface of the fabric 1, so that the chain guide can be adapted even better than before to its own requirements.

For the embodiment of a support device 20 that flexibly follows the width of the fabric, as shown in FIG. 5, there are various options. For instance, the arrangement of bars or tubes 21 that fold together in "accordionlike" fashion as in FIG. 5 is possible; they are secured to the chain guides 17 and can be pushed together and pulled apart in the widthwise direction 24 of the fabric 1. Each of these bars (or tubes) 21 may carry one or more injector nozzles 5 to be used according to the invention. The compressed air supply to each of the injector nozzles 5 can be conducted along the barsor tubes 21, or can preferably be effected through the tubes themselves.

One favorable embodiment of the support device 20 for the nozzles 5 is shown in FIG. 6. According to it, the individual nozzles 5 are received in a scissors system 25, which comprises barsor tubes 21 that intersect at hinges 22. As can be seen from the drawing, the intersecting barsor tubes 21 that form the scissors system can be pulled apart or pushed together in the widthwise direction 24, depending on how wide the particular length of fabric to be treated is.

FIG. 7 shows a portion of the scissors system 25 of FIG. 6, on a larger scale. The barsor tubes 21 that carry the individual nozzles 5 are secured to a chain guide 4 in a hinge 23 and are joined to one another via hinges 22. The scissors system 25 is shown in FIG. 8 in section vertically to the plane of the fabric 1 to be treated (in a simplified embodiment). Each of the barsor tubes 21 carries a plurality of nozzles 5, whose compressed air supply can be passed through the tubes 15. Flexible compressed air lines can be provided at the hinges 22, 23 in order to supply the injector nozzles 5.

In an apparatus for blowing air at a length of textile fabric spread out between two chain guides and moved onward continuously, the blow-out nozzles may be embodied individually as injector nozzles or the like. In a development of this concept, the blowout nozzles may be brought arbitrarily close to the surface of the fabric and can be adapted flexibly in terms of their spatial distribution to the width of the fabric, if the nozzles are disposed individually essentially in one plane parallel to the surface of the fabric with spacings that at least in groups are the same mutually, in a fastening and air supply system that can be adapted to the width of the fabric.

What is claimed is:

1. An apparatus for blowing air at a traveling spread-out length of textile fabric (1) with the aid of an optionally heated treatment gas (7) flowing in accelerated fashion toward the length of fabric, comprising injector nozzles (5) disposed on at least one side of the surface of the length of fabric and aimed at the length of fabric, particularly in a tentering frame in the textile industry, with each nozzle including an injector to accelerate the treatment gas; a compressed air supply for delivering compressed air to said injector nozzles (5) individually or in groups, means for heating the treatment gas via waste heat, and a gas turbine for driving said injector nozzles.

2. The apparatus of claim 1, wherein the number of nozzles per unit of surface area is adjustable for varying the blowing of air at the surface of the length of fabric.

3. The apparatus of claim 1 wherein selected nozzles are aimed at an edge region of the fabric, regardless of its width.

4. The apparatus of claim 1, further comprising means for providing steam under pressure to drive the injector nozzles (5).

5. The apparatus of claim 1, wherein a spacing between blow-out holes (6) of the injector nozzles (5) and the surface of the length of fabric (1) being treated is predetermined adjustably, independently of the structural height of a chain guide (17) that continuously transports the fabric.

6. The apparatus of claim 1, further comprising chain guide means (17) for transporting the length of fabric at the edges of the fabric in planar form, wherein the injector nozzles (5) include blow-out holes (6), and wherein a spacing between the blow-out holes (6) of the injector nozzles (5) and the surface of the length of fabric (1) is smaller than the dimension, measured in the same direction, of a portion of the chain guide means (17) located above the plane defined by the surface of the length of fabric (1).

7. The apparatus of claim 1, wherein the injector nozzles (5) are connected individually or in groups to a gas pressure system (12), each via one line.

8. The apparatus of claim 1, wherein the number of nozzles per unit of surface area is adjustable for varying the blowing of air at the surface of the length of fabric.

9. The apparatus of claim 1, wherein selected nozzles are aimed at an edge region of the fabric, regardless of its width.

10. The apparatus of claim 1, wherein the injector nozzles (5) are acted upon with the treatment gas only at an edge of the fabric.

11. The apparatus of claim 1, wherein the injector nozzles (5) are acted upon with the treatment gas only at an edge of the fabric.

* * * * *